US008931188B2

(12) United States Patent
Barchet

(10) Patent No.: US 8,931,188 B2
(45) Date of Patent: Jan. 13, 2015

(54) SNOWSHOE WITH PIVOTED BOOT BINDING

(75) Inventor: Chris Barchet, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 828 days.

(21) Appl. No.: 12/590,847

(22) Filed: Nov. 13, 2009

(65) Prior Publication Data

US 2011/0113651 A1 May 19, 2011

(51) Int. Cl.
*A43B 5/04* (2006.01)
*A63C 13/00* (2006.01)

(52) U.S. Cl.
CPC ..... *A63C 13/006* (2013.01); *A43B 5/0401* (2013.01); *A43B 5/04* (2013.01); *A63C 13/003* (2013.01)
USPC ..... 36/125; 36/122; 36/123

(58) Field of Classification Search
USPC ..... 36/122, 123, 124, 125
See application file for complete search history.

(56) References Cited

U.S. PATENT DOCUMENTS

| | | | | |
|---|---|---|---|---|
| 2,987,834 | A | 6/1961 | Howe | |
| 5,699,630 | A | 12/1997 | Klebahn et al. | |
| 5,809,667 | A | 9/1998 | Liautaud | |
| 6,006,453 | A | 12/1999 | Klebahn et al. | |
| 6,898,874 | B2 * | 5/2005 | Emerson et al. | 36/122 |
| 6,931,769 | B2 | 8/2005 | Mahoney et al. | |
| 8,020,321 | B2 * | 9/2011 | Matthews et al. | 36/122 |
| 2008/0263902 | A1 | 10/2008 | Chartrand et al. | |

* cited by examiner

*Primary Examiner* — Jila M Mohandesi
*Assistant Examiner* — Katharine Gracz
(74) *Attorney, Agent, or Firm* — Thomas M. Freiburger

(57) ABSTRACT

A snowshoe has an improved spring-loaded suspension system that reduces or eliminates snow flip as the user lifts the boot and advances it forward. In a principal embodiment the footbed and front claw of the binding are positioned on a spring-suspended frame in such a way that the footbed/claw can freely rotate relative to the snowshoe deck beyond a certain degree of pitch angle.

9 Claims, 7 Drawing Sheets

FIG. 4
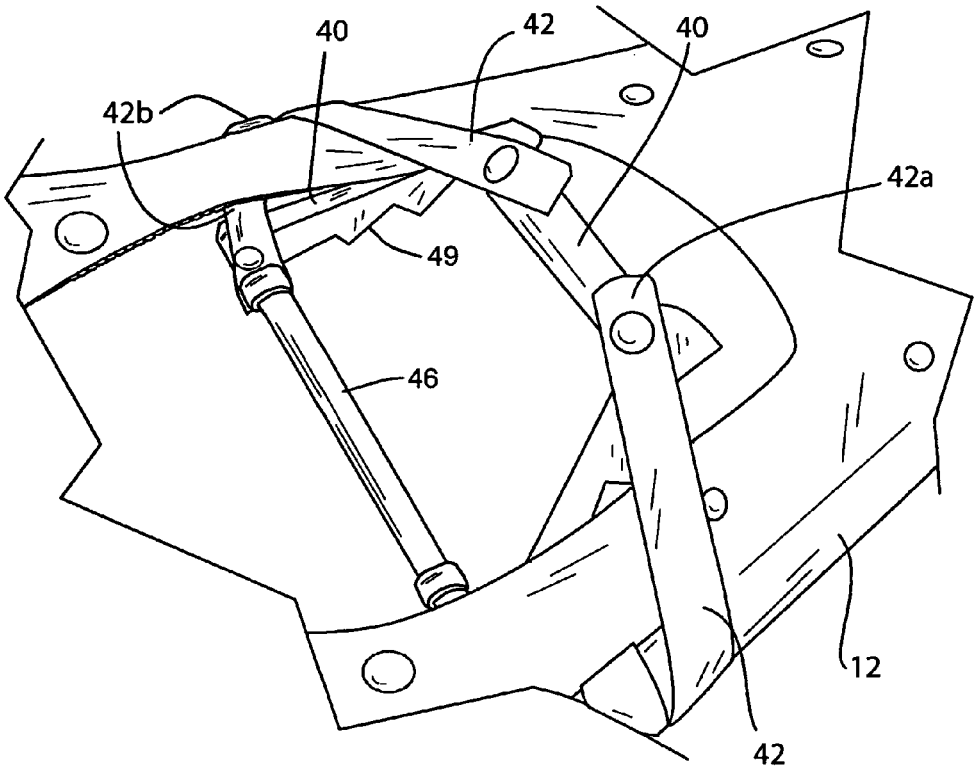
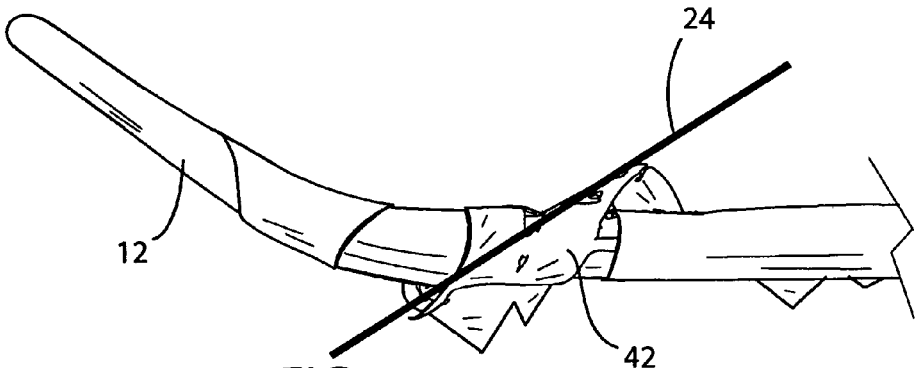
FIG. 5

FIG. 8
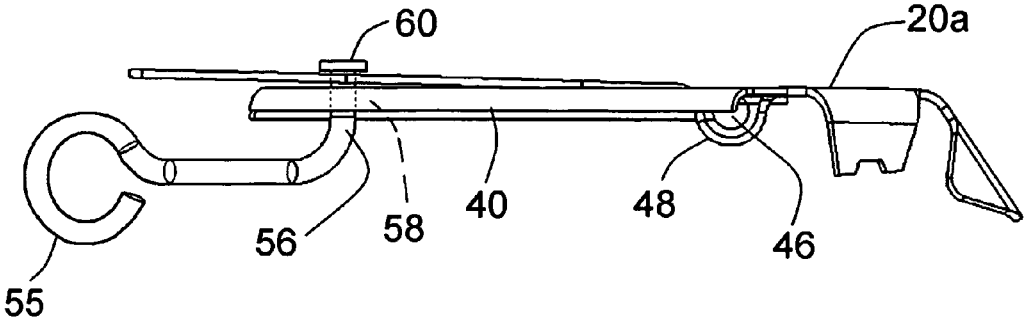
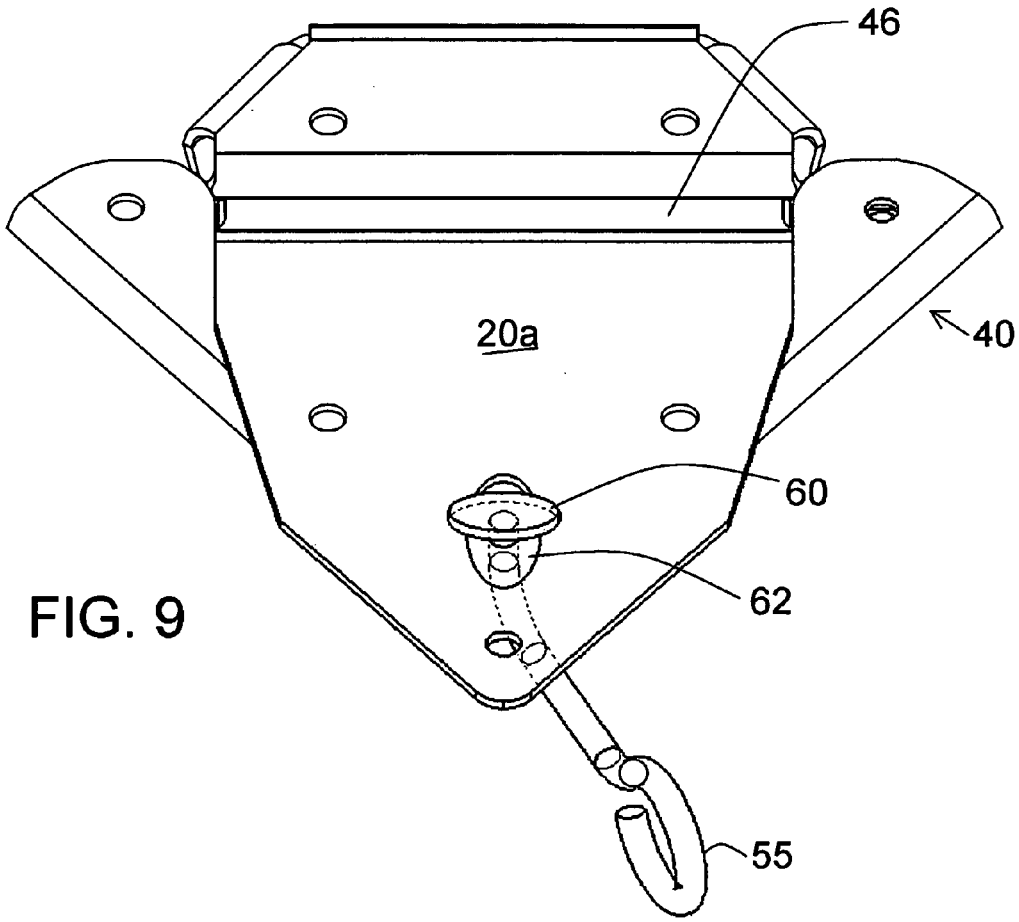
FIG. 9

SNOWSHOE WITH PIVOTED BOOT BINDING

BACKGROUND OF THE INVENTION

This invention concerns snowshoes with provision for pitch rotation of the snowshoe deck relative to the boot binding, and especially such pitch-rotating snowshoes wherein some form of spring urges the snowshoe deck to rotate toward a defined neutral position relative to the boot and binding.

Atlas Snowshoe Co. U.S. Pat. No. 5,699,630 shows an example of the type of snowshoe to which this invention applies. The tubing frame-type snowshoe has a boot binding that connects to the frame via a tensioned strap. The strap or straps extend from the binding platform left and right to connections with the tubing frame, wrapping around the frame. This allows rotation of the binding in the pitch direction relative to the snowshoe deck, while also exerting a force as the binding is rotated, urging the binding to rotate back toward a neutral position defined by the strap alignment. The spring function in the snowshoe of U.S. Pat. No. 5,699,630 is primarily accomplished by a slight drawing in of the tubular frame members during pitch pivoting, by which the frame exerts a tensioning return force on the straps and thus a rotational force on the binding platform.

In the patented snowshoe the straps are actually attached to the footbed binding platform in such a way as to establish a neutral position in which the boot binding is tipped forward relative to the snowshoe, that is, a neutral position in which the tail of the snowshoe angles downwardly relative to the boot binding. Thus, as the user walks the snowshoe deck is biased or pre-loaded toward a tail-down, nose-up position, which prevents the snowshoes from catching on snow at the nose end as each snowshoe is advanced. Also, the described suspension system causes the snowshoe frame to follow the foot, tending to hold the snowshoe at the neutral position when the foot is lifted, making maneuvering, such as backing, and jumping easier, as compared to a snowshoe freely-pivoting in pitch. In this spring-loaded suspension system as in the above patent and others of Atlas Snowshoe Company, the suspension arrangement using the strap or straps allows the user to pitch-rotate the binding, from the neutral position, either in a downward direction toward the snowshoe platform or in an upward, deeper-pitch direction toward a larger tilt angle at the rear foot during walking. In either event the spring-bias or pre-load established by the strap suspension will urge the snowshoe deck back toward the neutral position relative to the binding. In most cases the neutral position is at approximately 30° to 45° but it could be from about 10° to about 45°, or it could even be 0° at the lower end of the range, as in some snowshoes having a binding suspended by a "toe chord". The strap system is also effective at allowing the user's boot to roll relative to the snowshoe deck (articulation). This allows a user to maintain a flat foot position while the deck conforms to terrain on traverses.

Typically the user during walking will position the rear foot in such a way as to tilt the binding forwardly/upwardly beyond the neutral position during part of the gait. This brief deep-pitch angling of the binding beyond the neutral position stores energy in the suspension system whereby the snowshoe deck wants to return up to the neutral position. Soft snow resting on the snowshoe deck is then flipped up onto the user's legs when the deck is allowed to return toward neutral as the toe of the user lifts off the snow. This is commonly known as snow-flip. The phenomenon occurs commonly in 0° neutral position snowshoes.

Although the spring-loaded suspension system of the above patent works very well, some users find the snow-flip effect objectionable. In particular, some users with a particular style of gait tend to generate a considerable snow-flip.

Previous solutions to the problem of snow-flip have been to adjust the bias angle, or to adjust the spring tension to a lighter tension. The adjustment of the bias angle, to the point that the neutral position was at a very high pitch angle, was not practical. The very high bias angle put greater loading on the spring tension when the binding was flat on the snowshoe, and it would allow the snowshoe to hang essentially vertically from the binding. Spring tension adjustment was only partially effective and was not capable of completely eliminating the snow-flip effect.

SUMMARY OF THE INVENTION

The invention eliminates the snow-flip problem. The suspension system of the invention is pre-loaded to bias the tail of the snowshoe toward a prescribed angle relative to the binding platform, but to allow free rotation of the snowshoe on the binding when the binding is pitched forward beyond the neutral position. This avoids loading the binding/snowshoe suspension when the binding is at an extreme pitch angle, as the user advances the opposite foot to a forward position. Thus, when the user lifts the rear, deeply pitched foot ("toe-off" position), there is no bias on the snowshoe deck tending to lift and flip up its tail end.

Several embodiments of the invention are possible. In one form, the new spring-loaded suspension system is similar to that of U.S. Pat. No. 5,699,630 except that the tensioned bands or straps are secured not to the binding directly but to a support frame, the support frame being at the preferred bias angle as a neutral position of the frame relative to the snowshoe deck. To this suspended support frame is secured the snowshoe binding platform, including a foot plate and preferably the front claw of the snowshoe. The binding may include a footbed, straps and other components. The binding is secured to the support frame along a horizontal pivot preferably from a forward end of the support frame, such that the binding normally rests on the support frame but can swing upwardly (pitch forwardly), about the horizontal pivot connection, when the user makes an extreme pitch angle of the boot and binding with the snowshoe frame, just before toe-off. Note that the rotation axis could be rear of the front end of the support frame such as in the case where the support frame is generally H-shaped, or at least with an open front end, allowing the forward pitch pivoting of the binding on the frame.

In this way, the boot binding acts the same as in the prior spring-loaded suspension system from a heel-down position through the upwardly-pitched neutral position of the support frame. Further forward pitching of the binding occurs in free pivoting, not affected by spring force, as the user enters an extreme pitch position and the support frame remains essentially in the neutral position (which may be about 10°-45°, or about 30° to 45°, for example). Because this introduces no torsional biasing force on the snowshoe during the extreme pitch position, the snowshoe tail will not flip upwardly at the point of toe-off, but rather the tail will essentially rest against the terrain.

In one specific embodiment the rotating connection includes a rotation limiter essentially preventing the deep pitch pivot from extending beyond a selected angle (which may be about 60°, 70° or 80°, for example) relative to the snowshoe deck. This can be effected by a rotation limiting tab on the binding platform that engages with structure of the support frame when the arc of rotation reaches the prescribed limit.

The suspension system of the invention can include a locking feature to hold the binding down to the support frame when desired.

Other forms of the invention can employ other types of suspension and bias springs, so long as the suspension provides for pitch pivoting of the binding relative to the snowshoe, biasing of the snowshoe tail downward for a selected arc of positions of the binding up to a neutral position of forward pitch, and free pivoting of the binding relative to the snowshoe beyond that neutral position, which may be limited at a steep upper angle. One example is a free-pivoting suspension such as Tubbs Snowshoe Co. U.S. Pat. No. 6,006,453, which is incorporated herein by reference, but fitted with one or more torsion springs to provide bias for only a portion of pitch pivoting range.

In another embodiment of the invention the neutral position can be at or near 0°, with essentially no tail-down biasing of the snowshoes. Some Tubbs snowshoes and Crescent Moon snowshoes have their bindings suspended by a simple "toe chord", which permits forward pitch pivoting of the binding on the snowshoe under spring force, but without any tail-down bias. Whether suspended by a toe chord or other spring suspension, this further embodiment of the invention can have a support frame suspended at essentially 0° degrees or deck-parallel position. The support frame is thus biased back toward the parallel position but is allowed to pitch forward against the spring bias. The binding is then attached at a horizontal pivot to the support frame for free-pivoting. In this embodiment the binding includes a locking feature to selectively hold the binding down against the support frame when desired. Thus, the user can select free-pivoting, which will allow the boot to rotate forward freely and without snow-flip, or spring-biased pitch movement with the binding fixed to the suspended support frame, still retaining the benefits of a suspended binding which allows flexibility including some roll of the boot on side terrain.

It is therefore among the objects of the invention to provide a spring-loaded suspension system for a snowshoe having the benefits of pre-loading or biasing of the snowshoe deck relative to the binding in pitch, toward a defined neutral position, but with a feature that allows additional freedom in a selected range of pitch, effective to eliminate the snow-flip phenomenon. These and other objects, advantages and features of the invention will be apparent from the following description of a preferred embodiment, considered along with the accompanying drawings.

DESCRIPTION OF THE DRAWINGS

FIGS. 4 and 5 are perspective and side elevation views showing a portion of a snowshoe with a spring loaded suspension system supporting a support frame providing for biased pitch rotation and on which a footbed/binding is to be pivotally mounted.

FIGS. 8 and 9 are side and upper elevation views showing one embodiment of a selectable locking device for holding the footbed/binding to the support frame.

DESCRIPTION OF PREFERRED EMBODIMENTS

Figure 1:
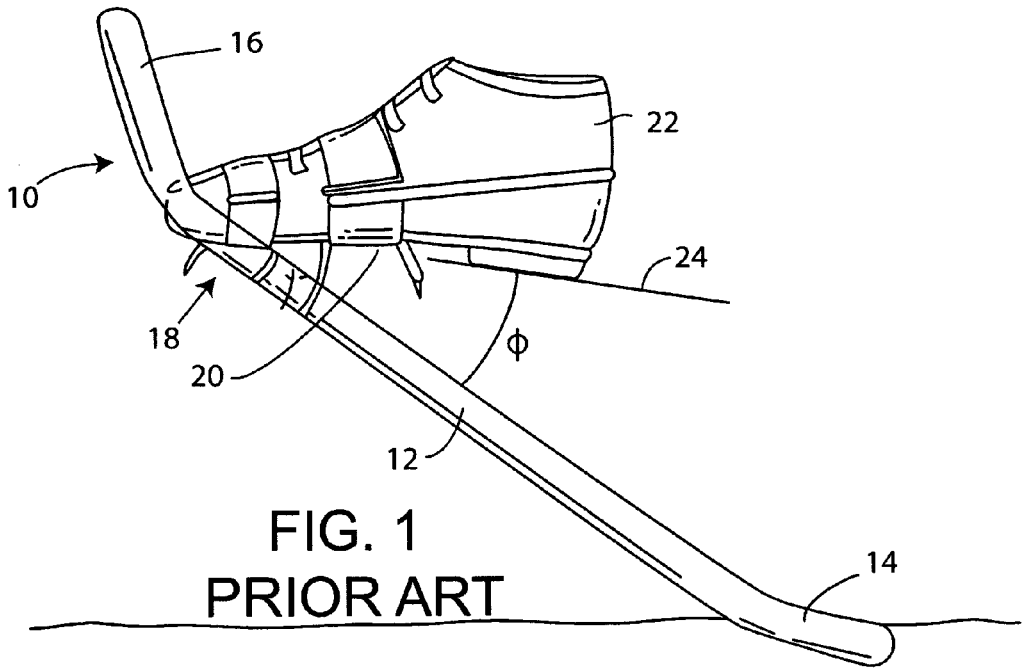
FIG. 1 PRIOR ART
FIG. 1 is a side elevation view schematically indicating a spring-loaded suspension system of a snowshoe binding on a snowshoe, in accordance with prior art.
Figure 2:
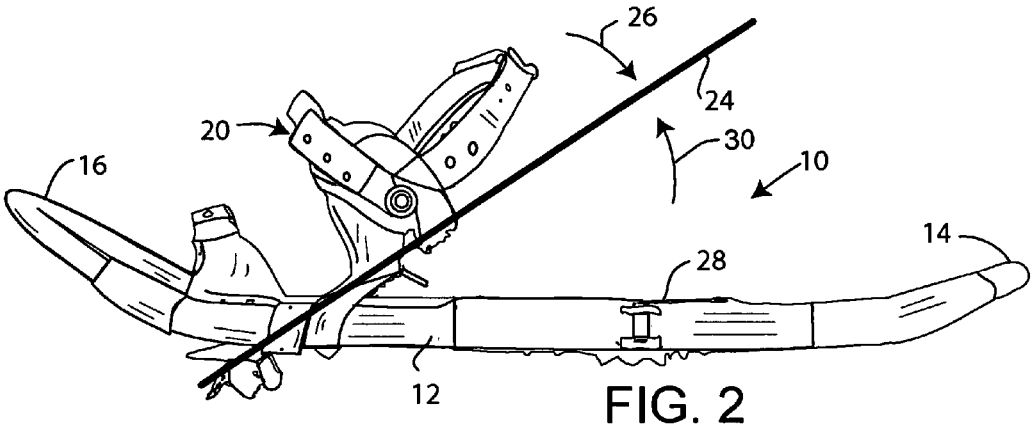
FIG. 2 PRIOR ART
FIG. 2 is a side elevation view, partially in perspective, indicating the prior art spring-loaded suspension system as in FIG. 1, indicating a neutral position and which spring bias is zero and showing ranges of rotation below and above the neutral position wherein spring-return force is applied.

FIG. 1 shows schematically a snowshoe 10 according to prior art, as in U.S. Pat. No. 5,699,630, with a peripheral frame 12 defining a snowshoe tail 14 and snowshoe nose 16, and with a spring-loaded suspension system generally indicated at 18. The suspension system provides for pivoting of the binding, schematically shown at 20, and the user's boot 22 about a pitch axis, with the binding being spring-biased via the suspension system toward a neutral position as shown in the drawing. The neutral position is at an angle $\phi$. The angle $\phi$ in some cases is about 30°-45°. As explained above, this type of suspension exerts a rotational biasing force toward the neutral position, whether the boot is tipped heel-downwardly toward the snowshoe or further pitched forward beyond the neutral position. This is outlined in FIG. 2, also showing the prior art system. The neutral position is shown in FIG. 2 and indicated by the line at 24 in the drawing. The upper arrow 26 indicates an arc of pitch movement in which the suspension system of U.S. Pat. No. 5,699,630 will bias the binding back down toward the neutral position, i.e. bias the snowshoe deck 28 and tail 14 upwardly relative to the binding. The arrow 30 in FIG. 2 indicates the biasing of the boot binding 20 back upwardly toward the neutral position, when the binding has been pivoted down against the snowshoe deck by the weight of the user. When the binding is within this arc, below the neutral position, the deck of the snowshoe is biased downwardly, toward the terrain.

Figure 3:
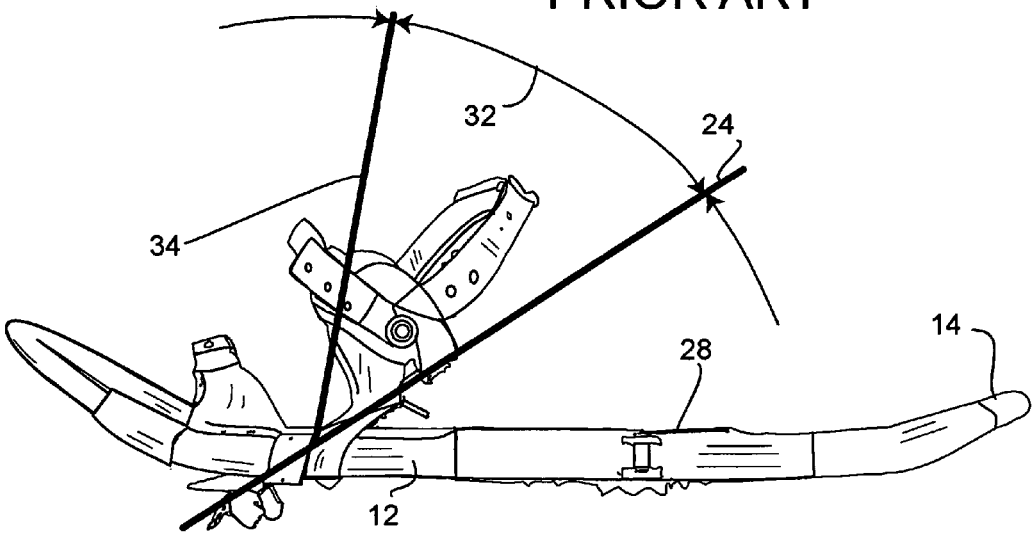
FIG. 3 is a side elevation view similar to FIG. 2 but indicating the operation of the spring-loaded binding suspension system of the invention.

FIG. 3 is a view similar to FIG. 2, but schematically indicating the invention whereby the binding 20 is allowed free rotation relative to the snowshoe deck when the binding is positioned at a deep pitch angle or extreme pitch position above the neutral position. The angular region of free rotation is indicated at 32 for this modified snowshoe 10*a*. As noted, the suspension system of the invention preferably includes a rotation limit, indicated by a radial line 34. This might be, for example, approximately 80°, preventing the snowshoe deck from hanging vertically from a boot held horizontal. The arc of free rotation above the neutral position allows the user to deeply pitch the binding relative to the snowshoe deck on his back foot as the opposite foot advances forward, without spring-loading the snowshoe deck such that the tail 14 tends to flip up at the point of toe-off (lifting of the back foot from the terrain).

Thus, the improved suspension system of the invention eliminates the snow-flip phenomenon by allowing the binding and front claw to rotate freely through part of the pitch rotation cycle. The design still maintains the benefit of a spring-loaded suspension system whereby the tail of the snowshoe is urged downwardly and the nose upwardly as the foot is advanced forward. Whereas the prior system had a unitary binding footbed/claw directly secured to the bias pivot mechanism such as a tensioned strap, the invention separates the bias pitch pivot mechanism (tension strap) and the binding/front claw. The interface between the tension strap (and/or other biased pivot mechanism) and the binding is a support frame that incorporates a free rotation feature, as seen below in FIGS. 4-7.

FIG. 4 shows one preferred embodiment for carrying out the principles of the invention. Here, a support frame 40 is secured to and suspended from the snowshoe frame by tension straps 42, which can be in the same manner that the binding 20 was supported in FIGS. 1 and 2, and as shown, for example, in U.S. Pat. No. 5,699,630. Thus, the straps 42 connect to the frame 40 (which can be generally rectangular, triangular or trapezoidal in shape, as shown) at a rear side of the frame, these strap ends 42*a* being connected preferably at a rear side of the frame 40, and extending from an upper level of the frame 12 at each of the left and right sides of the snowshoe frame. These tension straps 42 wrap around the frame as in the prior art binding support, and emerge from the frame as opposite strap ends 42*b* extending inward from the lower side of the frame 12 at each of left and right, to connections at a forward end of the frame 40, as shown. Therefore, the frame 40 is essentially in the same position and suspended in the same way as the prior art suspension of the binding platform/front claw assembly. It is in a neutral position, as indicated by the line 24 in FIG. 5, defining a pitched-forward position of the binding relative to the snowshoe deck, and this may be about 30° to 45° as in the prior suspension arrangements. The bias angle may actually be lower with the invention, such as about 20° to 30°, because of the free-rotation of the binding at pitch-forward positions above the neutral position, and thus no need to attempt a reduction of snow-flip by using a higher bias angle. The suspended support frame 40 includes a pivot bar 46 or similar structure to provide horizontal axis of pitch rotation of the footbed/binding to be secured to the support frame. In the embodiment illustrated this is a bar 46 positioned across the front of the support frame 40. This bar 46 can include an outer sleeve of nylon or LDPE (not specifically shown) for smoother pivoting.

Figure 3A:
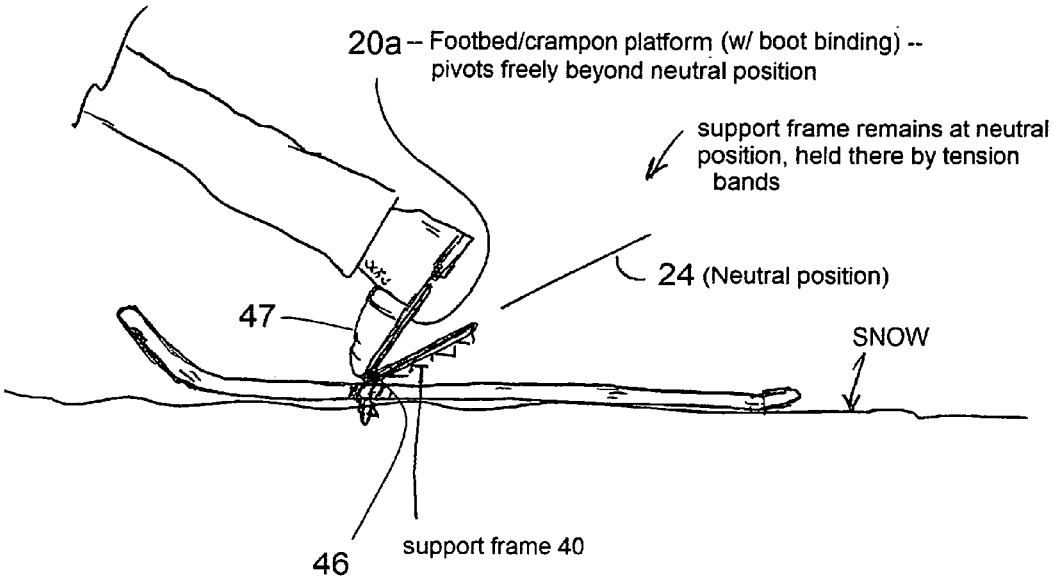
FIG. 3A is a side elevation view expanding on FIG. 3 and showing the entire snowshoe with the spring-loaded binding suspension or support frame shown at the neutral position and the user taking a forward step with the boot position at an extreme forward pitch angle, the boot binding rotated freely above the support frame in an arc of free rotation beyond the neutral position.

FIG. 3A expands on FIG. 3, showing a user's boot 47 at an extreme forward pitch angle as the user takes a step forward with the other lea. The support frame 40, biased to the neutral position indicated at 24, remains at that neutral position under the influence of the spring bias (which can be tension bands 42 as above). However, the footbed/crampon platform 20*a*, which is part of the boot binding, has freely pivoted to the extreme pitched-forward position via the free-pivoting connection axis indicated at 46. The boot binding is within the arc of free rotation. Note, however, that when the user's boot 47 steps back down and the footbed platform 28 again bears against the support frame 40, the binding will be biased along with the support frame 40 upwardly toward the neutral position indicated at 24.

Figure 6:
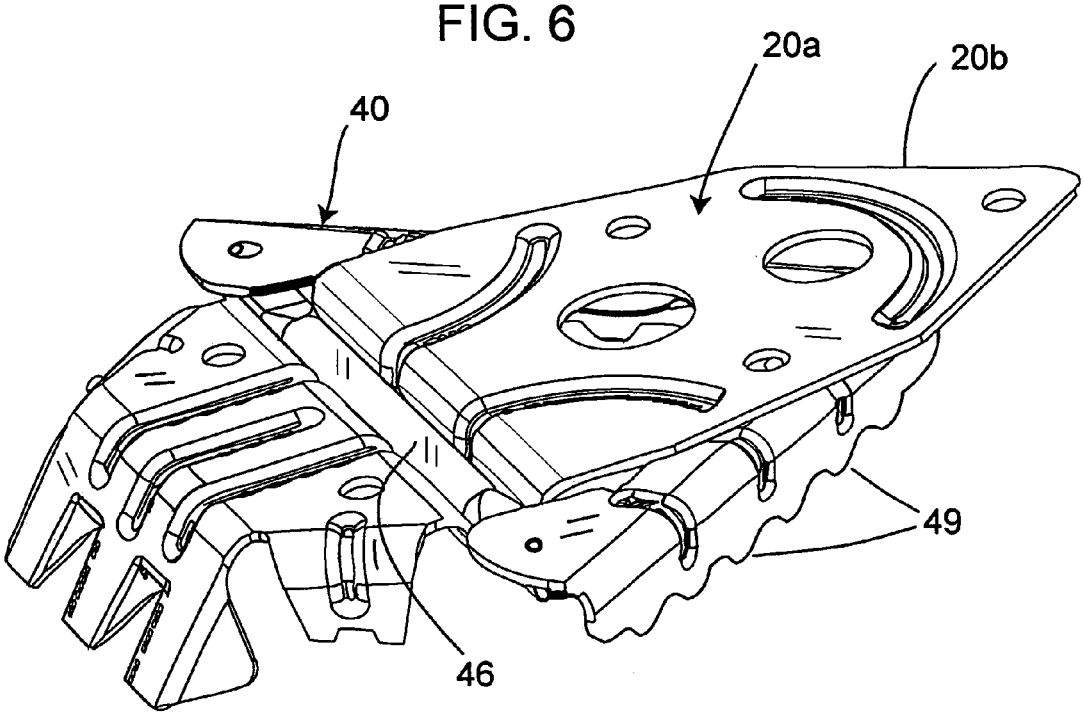
FIG. 6 is a perspective view showing a preferred embodiment of the invention for pivotal connection of a base plate of the footbed/binding to the support frame of the invention.
Figure 7:
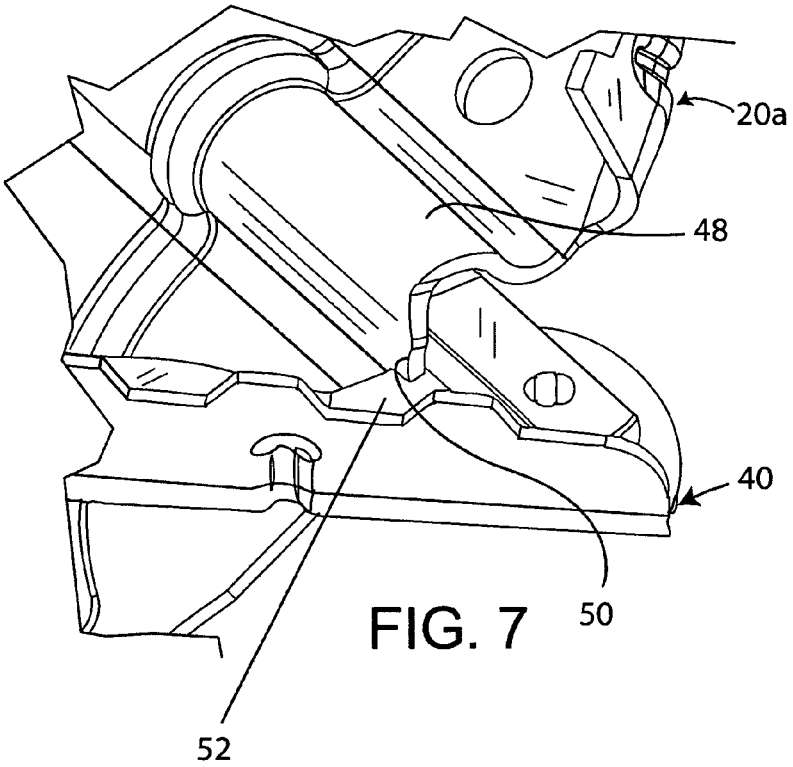
FIG. 7 is a detail view showing an embodiment in which the mechanism of FIG. 6 is provided with a rotation limiting device so that the pitch angle of the binding relative to the snowshoe frame will essentially not exceed a desired limit.

FIGS. 6 and 7 show details of one preferred type pivot connection between the support frame 40 and the metal platform/front claw 20*a*, forming a part of the binding assembly. The remaining binding assembly, which may include a semi-rigid footbed or plate secured above, straps or other devices to extend over boots, etc., is secured to this platform 20*a* in a conventional way. This is only one example of how these components can be connected to provide for forward pitch-pivoting of the platform 20*a* relative to the support frame 40, whereby the back end 20*b* of the platform 20*a* rises upwardly from the support frame during extreme pitch movements. In this arrangement, the platform unit 20*a* has a U-shaped deformation 48 as shown, forming a deep channel or groove as viewed from the upper side as in FIG. 6. This groove portion of the platform receives the pivot bar or rod 46 (which may have an outer sleeve as noted above), and can be retained in this channel by the binding components above (not shown). The crampon platform 20*a* and binding components (e.g. a footbed) above are fastened together with rivets or bolts, capturing the pivot bar 46 in the channel 48. When the binding is not in an extreme forward pitch position, the platform 20*a* rests down against the support frame 40.

FIGS. 6 and 7 show details of one preferred type pivot connection between the support frame 40 and the metal platform/front claw 20*a*, forming a part of the binding assembly. The remaining binding assembly, which may include a semi-rigid footbed or plate secured above, straps or other devices to extend over boots, etc., is secured to this platform 20*a* in a conventional way. This is only one example of how these components can be connected to provide for forward pitch-pivoting of the platform 20*a* relative to the support frame 40, whereby the back end 20*b* of the platform 20*a* rises upwardly from the support frame during extreme pitch movements. In this arrangement, the platform unit 20*a* has a U-shaped deformation 48 as shown, forming a deep channel or groove as viewed from the upper side as in FIG. 6. This groove portion of the platform receives the pivot bar or rod 46 (which may have an outer sleeve as noted above), and can be retained in this channel by the binding components above (not shown). The crampon platform 20*a* and binding components (e.g. a footbed) above are fastened together with rivets or bolts, capturing the pivot bar 46 in the channel 48. When the binding is not in an extreme forward pitch position, the platform 20*a* rests down against the support frame 40.

FIGS. 6 and 7 show that the support frame 40 has the potential to function as a traction device for engaging terrain. The support frame 40 can have teeth 49 at lower edges as shown. From FIGS. 4 and 5 it is seen these teeth will engage down against terrain when the heel pushes the frame 40 down to a position parallel to the snowshoe deck.

In one preferred embodiment the suspension system of the invention includes a rotation limiter to prevent the upward pitch rotation of the crampon platform 20*a* from exceeding a specified angle relative to the support frame 40. FIG. 7, a perspective view showing a portion of the support frame/crampon platform assembly from below, shows that the platform 20*a*, at a position on or near the U-shaped channel 48, can have a rotation limiting tab 50 that extends out laterally to engage a surface or edge 52 on the bottom surface of the support frame structure. This will provide a somewhat "soft" rotation limit to forward pitch of the binding, since the motion limiting device acts between the binding and the support frame 40, which is spring-suspended on the snowshoe. This rotation limit can be exceeded with application of sufficient force.

In other embodiments of the invention, a mechanism can be included to lock the binding/front claw assembly to the binding support frame when desired, under the control of the user. This can allow the user to eliminate the zone of free rotation if desired. In some circumstances a user might prefer that the snowshoe frame follow the path of the foot more closely and not be allowed to hang essentially vertically from the boot. FIGS. 8 and 9 show one example of a locking mechanism for holding the foot plate or binding plate (which preferably includes the front claw as indicated) against the support frame 40. In both FIGS. 8 and 9 the crampon/foot plate 20*a*, i.e. the binding, is held down to the support frame. The mechanism includes a handle 55 that can be accessed by the user, positioned so as not to interfere with pitch movement of the support frame. This handle has a stem 56 journalled for rotation to the support frame as indicated at 58. At the end of the stem 56 is a locking lug 60, shown as elliptical in this embodiment, that is rotated by the handle 55. FIGS. 8 and 9 show the elliptical locking lug 60 rotated in a locking position across a similar elliptical opening 62 in the crampon/binding foot plate 20*a*, thus holding the foot plate in place and serving as a means for selectively locking the boot binding down to the support frame. When the handle is rotated to a position in which the ellipses are aligned, the binding foot plate 20*a* is free to pivot in a pitch-forward rotation relative to the support frame 40. Other arrangements could be used, such as a simple pivoting clip on the side of the binding, preferably on a horizontal axis, that can be swung downwardly to engage a hook end of the clip under the support frame to lock the two together (not shown). A number of further implementations are possible.

In a different embodiment of the invention, the neutral position of the binding on the snowshoe deck can be essentially 0°, or close to 0°. In that case there is little or no spring-biasing of the snowshoe tail downward, but the flexible suspension holds the binding at or near the deck-parallel position. In this type of snowshoe, such as some Tubbs snowshoes and Crescent Moon snowshoes, the suspension simply exerts spring force throughout the full range of pitch pivoting, always tending to return the snowshoe back to parallel relationship with the binding. In this embodiment of the invention, however, a support frame such as described above and shown at 40 in FIGS. 8 and 9 is suspended by the flexible suspension system at approximately 0° relative to the snowshoe deck. Thus, the horizontal position schematically indicated in FIG. 8 would essentially be the neutral position in this embodiment of the snowshoe. The binding, including a foot plate 20*a* as in FIGS. 8 and 9, is connected along a horizontal pivot 46 to the support frame 40 as shown in FIGS. 8 and 9. Further, the selective locking feature shown in FIGS. 8 and 9 is also included in this embodiment of the snowshoe. Therefore, a user can select either the locked or unlocked mode. In the locked mode the binding will be allowed to pitch forward but always with a spring force tending to return the binding and snowshoe back to the parallel position. Snow-flip will tend to occur, but in some circumstances the user may want the positive spring connection of the binding to the snowshoe. In the unlocked position, the user will be able to freely pitch the binding forward relative to the snowshoe deck, without spring force, and snow-flip will not occur.

In another embodiment of the invention, a mechanism can be included that allows the user to adjust the bias of the support frame relative to the snowshoe deck, to allow the user to "tune" the performance of the snowshoes.

In another embodiment the support frame is not included. Instead, the snowshoe can be of the type shown in U.S. Pat. No. 6,006,453 referenced above, supported on a pivot shaft. In that patent the pitch was not biased, but in an embodiment of the invention one or two coil springs are included along the pivot axis, biasing the binding to a prescribed neutral position, a pitched-forward position of the binding as described above. The coil springs can be set so as to exert no further bias on the binding/snowshoe deck angle when the neutral position is reached; beyond that position, in extreme pitch-forward positions, the binding will be free-pivoting on the snowshoe frame.

Reference to a suspension connected to a snowshoe frame, in this description and in the claims, is intended to include not only a tubular frame snowshoe as depicted, but also a solid or molded snowshoe body or other non-tubular frame snowshoe, where the suspension connects to some component of the snowshoe; the term "frame" is to be understood broadly and not as limiting. References to the binding or footbed being parallel to the frame should be understood as meaning parallel to the deck in the case of a snowshoe without conventional peripheral frame.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A snowshoe having a boot binding connected to a snowshoe frame in a pivot suspension so as to permit pivoting of the boot binding in the pitch direction relative to the snowshoe frame to accommodate the gait of a user, comprising:

the pivot suspension comprising a support frame pivotally secured to the snowshoe frame for pitch pivoting relative to the snowshoe frame with the support frame spring-biased toward a neutral pitch position which is at an oblique forward pitch angle relative to the snowshoe frame, and the boot binding being above and connected to the support frame at a horizontal pivot axis connection on the support frame so as to permit the boot binding either to rest against the support frame or to freely pivot forward away from the support frame in the pitch direction from a position resting on the support frame to a position rotated to a greater forward pitch angle than the support frame in a free-pivoting movement relative to the support frame, the spring-biased support frame being effective to urge the boot binding along with the support frame toward the neutral pitch position when the support frame and boot binding have been rotated toward a parallel position with the snowshoe frame, whereby the spring-biasing of the support frame urges the snowshoe's tail end downwardly relative to the boot binding and a user's boot when the support frame is between the neutral position and a position parallel with the snowshoe frame, but wherein the boot binding can freely pitch forward beyond the pitch angle of the neutral position, at least to a selected degree, unaffected by spring-biasing when the user's boot enters an extreme pitch position relative to the snowshoe frame, thus avoiding a tendency of the snowshoe tail end to flip upwardly as the user walks forward and lifts the toe of a rear boot off terrain.

2. The snowshoe of claim 1, wherein the pivot suspension comprises tension bands secured to the snowshoe frame and extending inwardly to securements with the support frame, the tension bands being positioned to bias the support frame to a preselected forwardly pitched bias angle defining the neutral position and effective to spring-bias the support frame along with the boot binding to return to the neutral position when rotated toward a parallel position with the snowshoe frame.

3. The snowshoe frame of claim 2, wherein the tension bands are secured to the support frame such that rear, upper strap portions extend from an upper level on the snowshoe frame to a rear end of the support frame and forward, lower strap portions extend from a lower level on the snowshoe frame to a forward end of the support frame, providing the forwardly pitched bias angle.

4. The snowshoe of claim 1, wherein the horizontal pivot axis is generally at a front end of the support frame.

5. The snowshoe of claim 1, wherein the boot binding includes a foot plate, which is connected to the support frame with a pivot rod extending horizontally across the support frame and defining said horizontal pivot axis, and the binding including a channel extending horizontally across the foot plate within which the pivot rod is positioned, with further binding structure secured to a top side of the foot plate so as to capture the pivot rod in the channel, allowing the foot plate and binding to rotate in pitch relative to the support frame.

6. The snowshoe of claim 1, further including a means acting between the binding and the support frame for limiting the free-pivoting pitch movement of the boot binding relative to the support frame, to a selected range of pitch movement.

7. The snowshoe of claim 1, wherein the boot binding includes a foot plate with a front claw extending downwardly at a forward end of the foot plate.

8. The snowshoe of claim 1, wherein the support frame includes crampon teeth extending downwardly, in position to engage terrain when the boot binding is in a downward position essentially parallel to the snowshoe frame.

9. The snowshoe of claim 1, further including means for selectively locking the boot binding down against the support frame to prevent the free-pivoting movement of the boot binding when desired.

* * * * *